United States Patent [19]

Weston

[11] 4,395,605

[45] Jul. 26, 1983

[54] FLOAT OPERATED REED SWITCHES

[76] Inventor: William A. Weston, "The Barn", Portkil Bay, Kilcreggan, Helensburgh, Dunbartonshire, Scotland

[21] Appl. No.: 355,168

[22] Filed: Mar. 5, 1982

Related U.S. Application Data

[63] Continuation of Ser. No. 136,756, Apr. 3, 1980, abandoned.

[30] Foreign Application Priority Data

Apr. 5, 1979 [GB] United Kingdom ..... 7912014

[51] Int. Cl.[3] ..... H01H 35/18

[52] U.S. Cl. ..... 200/84 C; 137/92

[58] Field of Search ..... 137/192, 194, 202, 423, 137/434; 200/61.2, 84 R, 84 C; 73/308, 311, 313, 322.5; 340/624, 625

[56] References Cited

U.S. PATENT DOCUMENTS

| | | | |
|---|---|---|---|
| 2,536,273 | 1/1951 | Gahagan | 200/84 C |
| 2,736,013 | 2/1956 | Binford | 73/311 |
| 3,051,805 | 8/1962 | Binford | 200/84 C |
| 4,064,755 | 12/1977 | Bongort | 200/84 C |
| 4,079,743 | 3/1978 | Weston | 137/92 |

*Primary Examiner*—G. P. Tolin

*Attorney, Agent, or Firm*—Gerald J. Ferguson, Jr.; Joseph J. Baker

[57] ABSTRACT

In a switch device having a reed switch activated by a magnet carried by a first float, the differential between the reed switch being activated and de-activated is increased by providing a second float vertically spaced from the first float and arranged to hold the latter against switch de-activating movement when the liquid level changes and until the liquid level is such that the level of the second float changes to a predetermined level.

3 Claims, 3 Drawing Figures

FLOAT OPERATED REED SWITCHES

This is a continuation of application Ser. No. 136,756, filed Apr. 3, 1980, now abandoned.

FIELD OF THE INVENTION

This invention relates to switch devices incorporating reed switches. Such devices are currently used for starting and stopping pumps to control the level of liquids in tanks or other containers. Alternatively, in open water such as the sea or a loch such devices can be used to provide an indication of, or a warning with regard to critical levels. In the following description and claims the term 'activated' when applied to reed switches refers to the switch being closed. Similarly, the term 'de-activated' refers to the switch being opened.

BACKGROUND OF THE INVENTION

Other switches are available for such purposes, e.g. mercury switches and pressure switches, but these are not as reliable and are more expensive than reed switches. Furthermore, such known switches have been found to be inaccurate and variable in operation to an unacceptably wide degree.

Reed switches are cheap, highly reliable and accurate, but suffer from the disadvantages that they have a small differential between the switch being activated to the "on" position and de-activated to the "off" position, or vice versa. Thus, if they are float operated they can be used to detect only a very small change in liquid level.

An object of the present invention is therefore to obviate or mitigate the aforementioned disadvantages by providing means whereby a float-operated reed switch or float switch can detect greater differences in liquid levels than is possible with existing float-operated reed switches.

SUMMARY OF THE INVENTION

According to the present invention there is provided a switch device including a reed switch, a first float, a magnet carried by said first float for activating said reed switch in accordance with the level of the first float and magnet relative to the reed switch; in which there is provided a second float vertically spaced from the first float for holding the first float against movement in the direction for activating the reed switch when the liquid level changes and until the liquid level is such that the level of the second float changes to a predetermined level, whereby the differential between the reed switch being activated and de-activated is increased.

As a result of the invention, the differential between the closed and open conditions i.e. the activated and deactivated conditions may be extended by any given amount without interference to the switching mechanism of a standard production reed switch, and its "on/-off" settings can be predetermined, or extended as required.

BRIEF DESCRIPTION OF THE DRAWINGS

Embodiments of the invention will now be described, by way of example, with reference to the accompanying diagrammatic drawings, in which.

GENERAL DESCRIPTION

Figure 1:
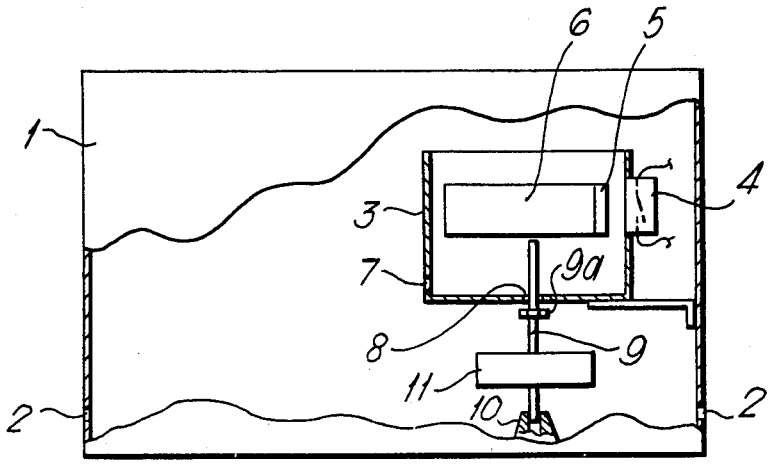
FIG. 1 shows one embodiment of a siwtch device according to the invention for operating a bilge pump.

Referring to FIG. 1 of the drawings, 1 is an outer container of any suitable shape and size in which a plurality of holes 2 are provided. Within the outer container 1, there is provided an inner container 3 of any suitable shape and size and on which is fitted a reed switch 4 adapted to be activated by a magnet 5 carried by a first float 6 within the inner container 3. At least one hole 7 is provided in the inner container 3 for the inlet and outlet of water and a hole 8 is provided in the base of the inner container 3 through which a spacer or push rod 9 can slide and project at its upper end into the inner container 3. A boss 10 or other guide is provided on the base of the outer container 1, in which a lower end portion of the push rod 9 is slideably located. The rod 9 has secured to it a second float 11.

A height-adjustable governor 9*a*, which may be a nut in which case the rod 9 is provided with a screw thread, is provided to control the height to which the push rod 9 can rise. Alternatively, the float 11 may be so situated on the push rod 9 that it acts as a stop when it rises to the base of the inner container 3.

The outer container 1 is located, in use, in the bilges of a boat, and the operation is as follows.

When the water level in the bilges rises sufficiently, water flows into the outer container 1, by way of the holes 2, eventually raising the float 11 and the push rod 9 to its full governed extent i.e. until the governor 9*a* strikes the base of the inner container 3.

The float 6 has been raised by the rod 9 sufficiently to have passed beyond the intermediate position of the switch 4, at which the switch is open. At this point, the proximity of the magnet is such that the magnetic force exerted by the magnet 5 is insufficient to activate the switch but is sufficient to hold it in an activated condition. The difference between the proximity which causes activation and the proximity at which de-activation occurs is commonly known as the switch differential.

A further rise in the water level causes water to enter the inner container 3 through the holes 7 or over its open top, thereby causing the float 6 to rise, until the proximity of the magnet to the switch 4 causes the latter to be activated.

On the liquid level lowering, the reverse takes place but the float 6 can only lower on to the top of the rod 9, and is maintained there with the switch activated until the level of the water lowers sufficiently to allow the float 11 to lower.

When the float 11 lowers, the rod 9 also lowers and so allows the float 6 to lower so that the switch 4 is de-activated.

When the switch 4 is activated, electric current can flow through the reed switch to operate a bilge pump to empty the bilges. On the lowering of the water level, float 6 would normally drop only a very small distance before the magnet 5 de-activated the switch so stopping the pump, but, because of float 11 and rod 9, which prevent the further fall of float 6, until such time as the water level lowers sufficiently to lower float 11, and, in turn float 6, the pump will remain operative thus removing a very much larger volume of water than would otherwise be possible.

The switch device may be used for detecting the levels of other liquids in other circumstances, and the switch device may be used to control an audible or visual warning device.

The switch device, and the bilge pump, or other device which it controls, can be tested by introducing water manually into the inner container 3 to raise the float 6, or by feeding water into the latter from the bilges or from the outer container 1 by means of a small electrical, mechanical or manual pump; the water subsequently draining through the holes 7 back to the outer container 1 and allowing the float 6 to lower, so cutting off the current flow through the reed switch 4. All parts, i.e. the float 6, the switch 4, and the warning device or the bilge pump, are thus easily tested.

When the switch device according to the invention is used to control a bilge pump, a switching differential of only 2", or thereby, is sufficient, but the switch differential can be predetermined or altered externally and without modification to the reed switch, to extend the differential by many inches, or even feet or yards if so desired. The switch device could therefore be used in, for example, a very large holding tank to keep a liquid height between any two predetermined levels.

Figure 2:
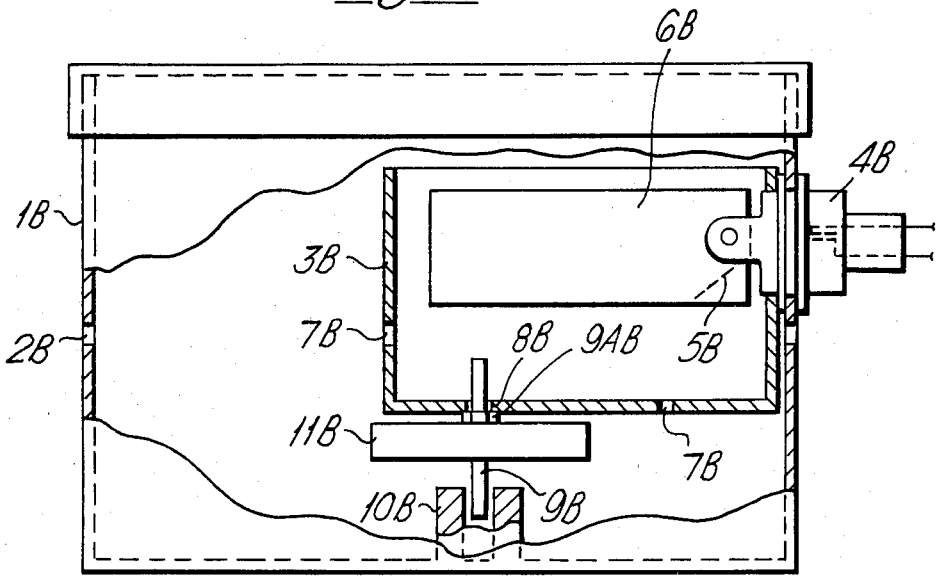
FIGS. 2 and 3 show second and third embodiments corresponding to FIG. 1.

The embodiment shown in FIG. 2 is similar to that above described, and like parts are indicated by like numerals with the suffix B. In FIG. 2, the main difference is that the first float 6B and the casing of the switch 4B together form a unit, the float 6B being pivotal relative to said casing which is secured to the outer and inner containers 1B and 3B, respectively.

Various modifications may be made without departing from the scope of the invention. For example the push rod 9 and float 6 may be replaced by a hollow floatable rod.

The outer container 1 may be omitted, and it is possible for the switch 4 to be carried by the float 6 and for the magnet 5 to be carried by the inner container 3 in FIG. 1.

It is to be noted that, whilst the examples given concern only float switches operated by reeds and magnets, the device could be used for any other purpose where it is necessary to have a reed-operated electrical make-and-break contact switch with an externally adjustable differential, or where it is desired that the differential is greater than that at present available in existing reed and magnet switches. That is to say, the invention can be used instead of an electrical delay device, which is relatively expensive.

The embodiment shown in FIG. 3 will now be described.

The switch device is located within a closed container 15 having an inlet 16 for liquid, and an outlet 17 through which liquid is withdrawn by a pump (not shown).

The switch device consists generally of a tube 18 which is secured at its lower end to the base of the container 15, an upper annular first float 19, a lower annular second float 20, and a spacer in the form of a sleeve 21 located between the floats 19 and 20, the floats and the sleeve being vertically slideable on the tube 18.

Two reed switches 22, 23 are fitted within the tube 18 one above the other at predetermined levels, and the first float 19 carries a permanent magnet 24 which creates a magnetic field extending across the tube 18. The tube 18 has upper and lower stops 25, 26 in the form of flanges for limiting movement of the second float 20, and a stop 27 at its upper end for limiting upward movement of the upper float 19 to a predetermined height. The tube 18 is also closed at its upper end.

The switch device shown in FIG. 3 operates as follows when filled with liquid.

If the level of liquid in the container 15 lowers to a predetermined height the upper float 19 lowers to a position in which the proximity of the magnet 24 closes (or opens as desired) the reed switch 22 to close or open an electric current.

If the liquid level lowers further, the float 19 lowers on to the sleeve 21 which is held in a predetermined position by the lower float 20, which itself is held in position by its floatability in the liquid, against the stop 25 on the tube 18.

At this point, the magnetic force from the magnet 24 is still within the range of the reed switch 22 and maintains its position (open or closed as desired).

If the liquid level drops still further to a lower predetermined height, i.e. below the flange 25, the lower float 20 falls thereby allowing the sleeve 21 and thus the upper float 19 to fall. The magnet 24 in the float 19 thus activates the lower reed switch 23 to open or close another electric circuit as desired.

The lower stop 26 on the tube 18 is positioned so that the lower float 20 can be arrested in its fall at a predetermined height, at which height both reed switches are still within the magnetic power of the magnet 24 in the float 19 and both activated to the closed, or open, or one closed and one open, position, as may be desired.

The sleeve 21 around the tube 18 is held centralized by flanges 28 on the tube 18.

Figure 3:
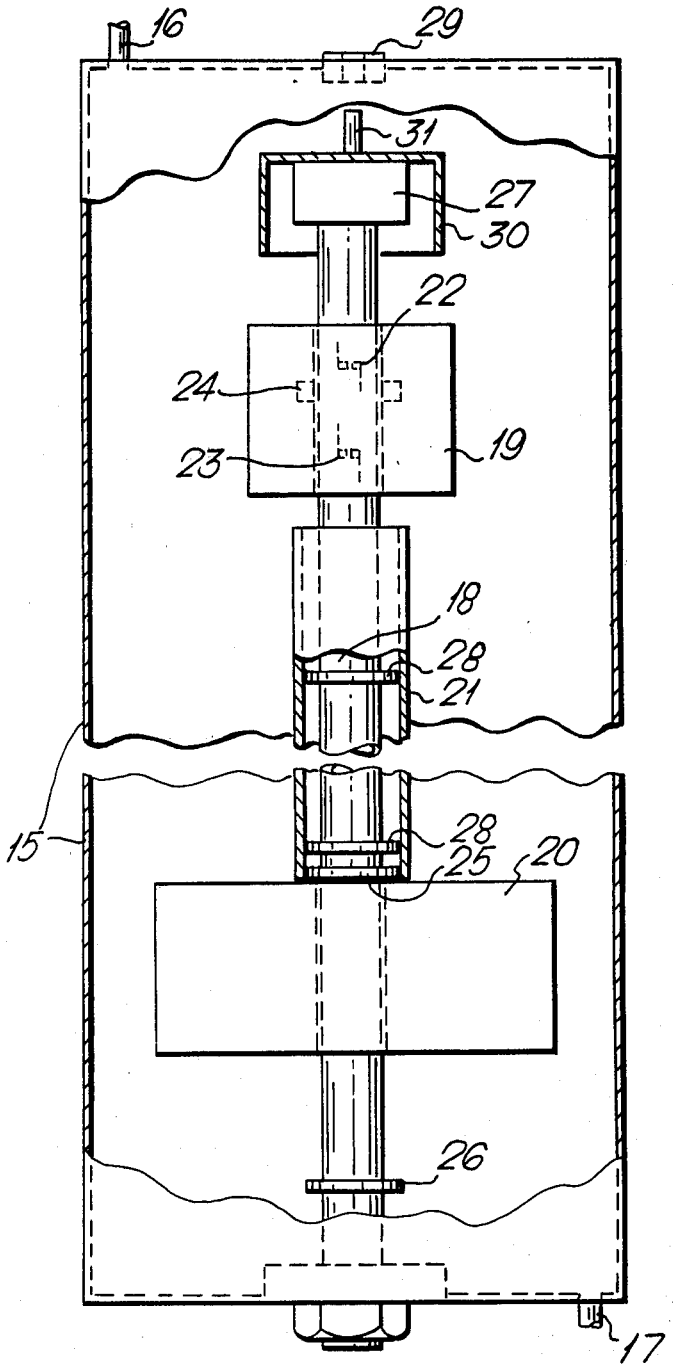

The embodiment described with reference to FIG. 3 is especially suitable for use as an air bleeding device in the fuel supply system of a fuel injection engine. The container 15 is therefore provided with an air bleed valve 29 (shown diagrammatically) on its top wall, and a valve control member 30. The latter consists of a cap which can rest on the upper end of the tube 18 when the float 19 has lowered and the valve 29 is open, and is pushed upwards by the float 19, when the latter rises, to effect closing of the valve 29. For this purpose, the cap 30 has a spigot 31 for engaging the movable member of the valve. When used as an air bleeding device the reed switch 22 is connected into the circuit of an electrical warning device, and the reed switch 23 is connected into a circuit controlling the fuel withdrawal pump. The air bleeding device operates in a manner generally similar to the air bleeding device disclosed in U.S. Pat. No. 4,079,743, the present switch device replacing in that Patent the pivotal float, the follower member, and the lower outlet valve and its associated parts.

In a modification of the FIG. 3 embodiment, the flanges 25 and 26 on the tube 18 may be replaced by baffle plates which act as stops and extend across the container 15 and have a number of through-apertures.

I claim:

1. A switch device responsive to the level of liquid in a vessel, comprising a reed switch, a first float, a magnet carried by said first float for activating said reed switch in accordance with the level of the first float and magnet relative to the reed switch; a second float vertically spaced from the first float, a container within said vessel, wherein the first float is located within the container and into which container liquid contained in the vessel can flow to a first predetermined level at which the switch is required to be activated and from which container liquid can flow when the level of the liquid falls to a second predetermined level; and in which the second float is secured to an upstanding rod which has an end portion for projecting slideably into the container to a predetermined limit; the arrangement being such that when the liquid level in the vessel rises, the liquid raises the second float so that the rod also rises and raises the first float, but not sufficiently to cause the reed switch to be activated; and upon a further predetermined rise in the level of the liquid, the liquid enters the container and raises the first float to a level at which the reed switch is activated; and upon lowering of the level of the liquid, the liquid flows out of the container, but the first float is held by the rod against movement, until the level of the liquid in the vessel lowers sufficiently to allow the second float and rod to lower to a level to free the first float allowing the first float to lower so that the reed switch is deactivated thereby extending the differential between the levels at which the switch is activated and de-activated.

2. A switch device responsive to the level of liquid in a vessel, comprising a reed switch, a first float, a magnet carried by said first float for activating said reed switch in accordance with the level of the first float and magnet relative to the reed switch; in which there is provided a second float vertically spaced from the first float which holds the first float against movement in the direction for de-activating the reed switch when the liquid level in the vessel changes a given amount and until the liquid level is such that the level of the second float changes to a predetermined level, whereby the differential between the reed switch being activated and de-activated is increased, wherein said first and second floats are annular and are slideably located on an upstanding tube secured within a container, a sleeve of predetermined length being slideably located on the tube between said floats, and including two vertically spaced reed switches located within said tube for activation successively by the magnet on the first float upon predetermined variations in the level of the liquid in the container, and including stops provided for limiting vertical movement of the second float.

3. A switch device as claimed in claim 2, in which said container includes an air bleed valve operable by said first float so as to open when the latter falls.

* * * * *